US011417252B2

(12) United States Patent
Bi et al.

(10) Patent No.: US 11,417,252 B2
(45) Date of Patent: Aug. 16, 2022

(54) OPEN CIRCUIT DETECTION METHOD AND LED DISPLAY DEVICE

(71) Applicant: CHIPONE TECHNOLOGY (BEIJING) CO., LTD., Beijing (CN)

(72) Inventors: Qian Bi, Beijing (CN); Yong Wang, Beijing (CN); Juncheng Geng, Beijing (CN)

(73) Assignee: CHIPONE TECHNOLOGY (BEIJING) CO., LTD., Beijing (CN)

( * ) Notice: Subject to any disclaimer, the term of this patent is extended or adjusted under 35 U.S.C. 154(b) by 120 days.

(21) Appl. No.: 16/967,786

(22) PCT Filed: May 17, 2019

(86) PCT No.: PCT/CN2019/087483
§ 371 (c)(1),
(2) Date: Aug. 6, 2020

(87) PCT Pub. No.: WO2020/191904
PCT Pub. Date: Oct. 1, 2020

(65) Prior Publication Data

US 2021/0225223 A1 Jul. 22, 2021

(30) Foreign Application Priority Data

Mar. 22, 2019 (CN) ..... 201910223997.X

(51) Int. Cl.
*G09G 3/00* (2006.01)
*G09G 3/32* (2016.01)

(52) U.S. Cl.
CPC ..... *G09G 3/006* (2013.01); *G09G 3/32* (2013.01); *G09G 2330/028* (2013.01); *G09G 2330/12* (2013.01)

(58) Field of Classification Search
CPC .... G09G 3/006; G09G 3/32; G09G 2330/028; G09G 2330/12; G09G 3/3216
(Continued)

(56) References Cited

U.S. PATENT DOCUMENTS 11,016,608 B2 * 5/2021 Chen ..... G09G 3/3696
11,061,422 B2 * 7/2021 Jin ..... G05F 1/59
(Continued)

FOREIGN PATENT DOCUMENTS

CN 1536544 10/2004
CN 101246659 8/2008
(Continued)

OTHER PUBLICATIONS

International Search Report and Written Opinion from PCT application serial No. PCT/CN2019/087483.
(Continued)

*Primary Examiner* — Giovanni Astacio-Oquendo
(74) *Attorney, Agent, or Firm* — Hogan Lovells US LLP

(57) ABSTRACT

An open circuit detection method and an LED display device are provided, relating to the technical field of LED display, wherein the open circuit detection method includes: supplying an open-circuit detection voltage to any row line to be detected among a plurality of row lines in the LED display device, and pulling down electric potentials of row lines other than the row line to be detected among the plurality of row lines to a first preset value, wherein the first preset value is smaller than an ON-voltage of each of the LED lamp beads and greater than 0; detecting whether the respective column lines include a column line having an electric potential lower than a second preset value, wherein if yes, it is determined that the LED display device has an LED lamp bead in an open circuit state.

20 Claims, 4 Drawing Sheets

(58) Field of Classification Search
USPC ..... 324/762.07, 762.01, 537, 500
See application file for complete search history.

(56) References Cited

U.S. PATENT DOCUMENTS

| | | | | |
|---|---|---|---|---|
| 11,132,930 | B2 * | 9/2021 | Wu | G09G 3/3688 |
| 2004/0196049 | A1 | 10/2004 | Yano et al. | |
| 2010/0171507 | A1 | 7/2010 | Hung | |
| 2012/0187854 | A1 | 7/2012 | Hideki | |
| 2017/0052228 | A1 * | 2/2017 | Hariharan | G01R 31/392 |
| 2017/0117591 | A1 * | 4/2017 | Ogg | G01R 31/396 |
| 2022/0050144 | A1 * | 2/2022 | Tawada | G01R 31/54 |

FOREIGN PATENT DOCUMENTS

| | | | |
|---|---|---|---|
| CN | 1019641166 | A | 2/2011 |
| CN | 102779479 | A | 11/2012 |
| CN | 105825806 | A | 11/2012 |
| CN | 103076532 | A | 5/2013 |
| CN | 203520832 | U | 4/2014 |
| CN | 104122506 | | 10/2014 |
| CN | 106251806 | | 12/2016 |
| CN | 106409194 | | 2/2017 |
| CN | 106604458 | A | 4/2017 |
| CN | 106887206 | A | 6/2017 |
| CN | 107274818 | A | 10/2017 |
| CN | 206601919 | U | 10/2017 |
| CN | 109377922 | | 2/2019 |
| CN | 108898989 | | 11/2019 |
| CN | 109870526 | A | 11/2019 |
| EP | 2387021 | | 11/2011 |
| EP | 3379901 | | 9/2018 |
| JP | 1980130243 | | 9/1980 |
| JP | 2001125540 | A | 5/2001 |
| JP | 2018160664 | | 10/2018 |
| KR | 20130116126 | | 10/2013 |

OTHER PUBLICATIONS

Decision to Grant Patent JP Application Serial No. 2020-548938 dated Jan. 19, 2022.
Grant of KR Patent No. 10-2020-7022733 dated Feb. 21, 2022.
International Search Report from Application Serial No. PCT/CN2019/087483 dated Dec. 9, 2019.
Notification of Grant from CN Patent Application Serial No. 201910223997 dated Oct. 9, 2020.
JP Office Action dated Oct. 12, 2021 from Application Serial No. 2020-548938.
KR Office Action dated Aug. 27, 2021 from Application Serial No. 10-2020-7022733.
Second CN Office Action from Application Serial No. 201910223997 (unknown date).
Written Opinion of the ISA from Application Serial No. PCT/CN2019/087483 dated Dec. 13, 2019.

* cited by examiner

OPEN CIRCUIT DETECTION METHOD AND LED DISPLAY DEVICE

CROSS-REFERENCE TO RELATED APPLICATIONS

The present disclosure claims priority of Chinese Patent Application No. 201910223997.X, filed with the Chinese Patent Office on Mar. 22, 2019, entitled "Open Circuit Detection Method and LED Display Device", the contents of which are incorporated herein by reference in their entirety.

TECHNICAL FIELD

The present disclosure relates to the technical field of LED display, and in particular to an open circuit detection method and an LED display device.

BACKGROUND ART

In a detection of an open circuit in an LED (Light Emitting Diode) display device, it is generally detected whether an LED lamp bead controlled at the intersection between a row line and a column line is in an open circuit state according to whether the column line is floating (according to the magnitude of the electric potential of the column line). For example, as shown in FIG. 1, assuming that the LED lamp bead 2-2 is in an open circuit state, each of the column lines corresponding to OUT1, OUT3, and OUT4 respectively has an electric potential Vout=Vdd−Vf when an open circuit is being detected in the second row. Since the LED lamp bead 2-2 is open-circuited, a column line corresponding to OUT2 is in a floating state and the electric potential of the column line corresponding to OUT2 is much lower than Vdd−Vf, so that it can be determined that the LED lamp bead controlled by the column line corresponding to OUT2 and the row line in the second row is in an open circuit state, wherein Vdd is an open-circuit detection voltage supplied by a row driving module, and Vf is an ON-voltage of the LED lamp bead.

However, once there is a short-circuited lamp bead in the display area of the LED display device, an LED lamp bead in an open circuit state in the LED display device cannot be correctly detected in the prior art, which may cause a failure in detection of an open circuit.

SUMMARY

The present disclosure provides an open circuit detection method and an LED display device, which will be described below.

In one aspect, an embodiment of the present disclosure provides an open circuit detection method applicable to detecting an open circuit in an LED lamp bead of an LED display device, the LED display device including a plurality of row lines, a plurality of column lines, and a plurality of LED lamp beads, wherein each of the LED lamp beads has a positive electrode connected with one of the row lines, and a negative electrode connected with one of the column lines, and the open circuit detection method includes:

supplying an open-circuit detection voltage to any row line to be detected among the plurality of row lines, and pulling down to a first preset value the electric potentials of the row lines other than the row line to be detected among the plurality of row lines, wherein the first preset value is smaller than an ON-voltage of each of the LED lamp beads and greater than 0; and detecting whether the respective column lines include a column line having an electric potential lower than a second preset value, wherein if the column line having an electric potential lower than a second preset value exists, it is determined that the LED display device has an LED lamp bead in an open circuit state.

In an optional embodiment of the present disclosure, prior to the step of supplying an open-circuit detection voltage to any row line to be detected among the plurality of row lines, and pulling down to a first preset value the electric potentials of the row lines other than the row line to be detected among the plurality of row lines, the open circuit detection method further includes:

detecting whether the LED display device has an LED lamp bead in a short-circuited state;

wherein if the LED display device has an LED lamp bead in a short-circuited state, the step of supplying an open-circuit detection voltage to any row line to be detected among the plurality of row lines, and pulling down to a first preset value the electric potentials of the row lines other than the row line to be detected among the plurality of row lines is executed.

In an optional embodiment of the present disclosure, the detecting whether the LED display device has an LED lamp bead in a short-circuited state includes:

supplying a short-circuit detection voltage to any row line to be detected among the plurality of row lines;

detecting whether the respective column lines include a column line having an electric potential higher than a third preset value or an electric potential equal to the short-circuit detection voltage, wherein if the column line having an electric potential higher than a third preset value or an electric potential equal to the short-circuit detection voltage exists, it is determined that the LED display device has an LED lamp bead in a short-circuited state.

In an optional embodiment of the present disclosure, the open circuit detection method further includes:

supplying an open-circuit detection voltage to any row line to be detected among the plurality of row lines and bringing into an idle state the row lines other than the row line to be detected among the plurality of row lines if the LED display device does not have an LED lamp bead in a short-circuited state;

detecting whether the respective column lines include a column line having an electric potential lower than the second preset value, wherein if the column line having an electric potential lower than the second preset value exists, it is determined that the LED display device has an LED lamp bead in an open circuit state.

In an optional embodiment of the present disclosure, the pulling down to a first preset value the electric potentials of the row lines other than the row line to be detected among the plurality of row lines includes:

pulling down to a first preset value the electric potentials of the row lines other than the row line to be detected among the plurality of row lines and then releasing the electric potentials; or continuously pulling down to a first preset value the electric potentials of the row lines other than the row line to be detected among the plurality of row lines.

In an optional embodiment of the present disclosure, the open circuit detection method further includes:

determining an LED lamp bead located at an intersection between the row line to be detected and the column line having an electric potential lower than the second preset value as the lamp bead in an open circuit state.

In an optional embodiment of the present disclosure, the open-circuit detection voltage is greater than the ON-voltage of the LED lamp beads.

In an optional embodiment of the present disclosure, prior to the step of supplying an open-circuit detection voltage to any row line to be detected among the plurality of row lines, and pulling down to a first preset value the electric potentials of the row lines other than the row line to be detected among the plurality of row lines, the open circuit detection method further includes:

switching from a current display mode to an open circuit detection mode in response to an open circuit detection command and based on the open circuit detection command.

In another aspect, an embodiment of the present disclosure also provides an open circuit detection method applicable to detecting an open circuit in an LED lamp bead of an LED display device, wherein the LED display device includes a plurality of row lines, a plurality of column lines, and a plurality of LED lamp beads, each of the LED lamp beads has a positive electrode connected with one of the row lines, and a negative electrode connected with one of the column lines, and the open circuit detection method includes:

detecting whether the LED display device has an LED lamp bead in a short-circuited state, wherein if the LED display device has the LED lamp bead in a short-circuited state, a row line corresponding to the LED lamp bead in a short-circuited state is determined as a short-circuited row line;

supplying an open-circuit detection voltage to any row line to be detected other than the short-circuited row line among the plurality of row lines, pulling down to a first preset value the electric potential of the short-circuited row line, and bringing into an idle state the row lines other than the short-circuited row line and the row line to be detected among the plurality of row lines, wherein the first preset value is smaller than an ON-voltage of each of the LED lamp beads and greater than 0; and detecting whether the respective column lines include a column line having an electric potential lower than a second preset value, wherein if the column line having an electric potential lower than the second preset value exists, it is determined that the LED display device has an LED lamp bead in an open circuit state.

In an optional embodiment of the present disclosure, the detecting whether the LED display device has an LED lamp bead in a short-circuited state includes:

supplying a short-circuit detection voltage to any row line to be detected among the plurality of row lines; and detecting whether the respective column lines include a column line having an electric potential higher than a third preset value or an electric potential equal to the short-circuit detection voltage, wherein if the column line having an electric potential higher than the third preset value or an electric potential equal to the short-circuit detection voltage exists, it is determined that the LED display device has an LED lamp bead in a short-circuited state.

In an optional embodiment of the present disclosure, the pulling down to a first preset value the electric potential of the short-circuited row line includes:

pulling down to a first preset value the electric potential of the short-circuited row line and then releasing the electric potential; or continuously pulling down the electric potential of the short-circuited row line to the first preset value.

In an optional embodiment of the present disclosure, the open circuit detection method further includes:

supplying an open-circuit detection voltage to any row line to be detected among the plurality of row lines and bringing into an idle state the row lines other than the row line to be detected among the plurality of row lines if the LED display device does not have an LED lamp bead in a short-circuited state; and detecting whether the respective column lines include a column line having an electric potential lower than the second preset value, wherein if the column line having an electric potential lower than the second preset value exists, it is determined that the LED display device has an LED lamp bead in an open circuit state.

In an optional embodiment of the present disclosure, the open-circuit detection voltage is greater than the ON-voltage of the LED lamp beads.

In an optional embodiment of the present disclosure, the method further includes:

determining an LED lamp bead located at an intersection between the row line to be detected and the column line having an electric potential lower than the second preset value as the lamp bead in an open circuit state.

In a further aspect, an embodiment of the present disclosure also provides an LED display device, the LED display device including:

an LED display array including a plurality of row lines, a plurality of column lines, and a plurality of LED lamp beads, wherein each of the LED lamp beads has a positive electrode connected with one of the row lines, and a negative electrode connected with one of the column lines;

a row driving module connected with each of the row lines, wherein the row driving module is configured to supply an open-circuit detection voltage to any row line to be detected among the plurality of row lines and to pull down to a first preset value the electric potentials of the row lines other than the row line to be detected among the plurality of row lines, wherein the first preset value is smaller than an ON-voltage of each of the LED lamp beads and greater than 0;

a column driving module connected with each of the column lines, wherein the column driving module is configured to supply a driving voltage to each of the column lines so that a voltage difference is formed between both ends of an LED lamp bead connected with the row line to be detected to allow the LED lamp bead to be turned on;

a controller respectively connected with the row driving module and the column driving module, wherein the controller is configured to control the row driving module to supply an open-circuit detection voltage to any row line to be detected among the plurality of row lines and to pull down to a first preset value the electric potentials of the row lines other than the row line to be detected among the plurality of row lines, wherein the first preset value is smaller than the ON-voltage of each of the LED lamp beads and greater than 0; and the controller is further configured to detect whether the respective column lines include a column line having an electric potential lower than a second preset value, wherein if the column line having an electric potential lower than the second preset value, it is determined that the LED display device has an LED lamp bead in an open circuit state.

In an optional embodiment of the present disclosure, the column driving module is a constant current source driving module.

In a still further aspect, an embodiment of the present disclosure also provides an LED display device, the LED display device including:

an LED display array including a plurality of row lines, a plurality of column lines, and a plurality of LED lamp beads, wherein each of the LED lamp beads has a positive electrode connected with one of the row lines, and a negative electrode connected with one of the column lines;

a row driving module connected with each of the row lines, wherein the row driving module is configured to supply, when the plurality of row lines include a short-circuited row line, an open-circuit detection voltage to any row line to be detected other than the short-circuited row line among the plurality of row lines, pull down to a first preset value the electric potential of the short-circuited row line, and bring into an idle state the row lines other than the short-circuited row line and the row line to be detected among the plurality of row lines, wherein the short-circuited row line is a row line corresponding to an LED lamp bead in a short-circuited state, and the first preset value is smaller than an ON-voltage of each of the LED lamp beads and greater than 0;

a column driving module connected with each of the column lines, wherein the column driving module is configured to supply a driving voltage to each of the column lines so that a voltage difference is formed between both ends of an LED lamp bead connected with the row line to be detected to allow the LED lamp bead to be turned on;

a controller respectively connected with the row driving module and the column driving module, wherein the controller is configured to: detect whether the LED display device has an LED lamp bead in a short-circuited state, wherein if the LED display device has an LED lamp bead in a short-circuited state, a row line corresponding to the LED lamp bead in a short-circuited state is determined as a short-circuited row line; and to control the row driving module to supply an open-circuit detection voltage to any row line to be detected other than the short-circuited row line among the plurality of row lines, pull down to a first preset value the electric potential of the short-circuited row line, and bring into an idle state row lines other than the short-circuited row line and the row line to be detected among the plurality of row lines, wherein the first preset value is smaller than the ON-voltage of each of the LED lamp beads and greater than 0; and the controller is further configured to detect whether the respective column lines include a column line having an electric potential lower than a second preset value, wherein if the column line having an electric potential lower than the second preset value exists, it is determined that the LED display device has an LED lamp bead in an open circuit state.

In an optional embodiment of the present disclosure, the column driving module is a constant current source driving module.

The embodiments of the present disclosure provide an open circuit detection method and an LED display device, wherein while an open-circuit detection voltage is supplied to the row line to be detected, the electric potentials of row lines other than the row line to be detected are pulled down to a first preset value which is greater than zero and smaller than the ON-voltage of each LED lamp bead, and then the presence or absence of an open circuit problem in an LED lamp bead connected with the row line to be detected is judged according to the presence or absence of a column line having an electric potential lower than the second preset value in the respective column lines, thereby improving the validity and accuracy of detection of an open circuit in an LED lamp bead of the LED display device.

Moreover, the open circuit detection method provided in the present disclosure can effectively avoid the problem of failure in open circuit detection caused by the presence of a short-circuited lamp bead in the LED display device in the prior art.

BRIEF DESCRIPTION OF DRAWINGS

In order to more clearly illustrate technical solutions of embodiments of the present disclosure, drawings required for use in the embodiments will be described briefly below. It is to be understood that the drawings below are merely illustrative of some embodiments of the present disclosure, and therefore should not be considered as limiting its scope. It will be understood by those of ordinary skill in the art that other relevant drawings can also be obtained from these drawings without any inventive effort.

Figure 1:
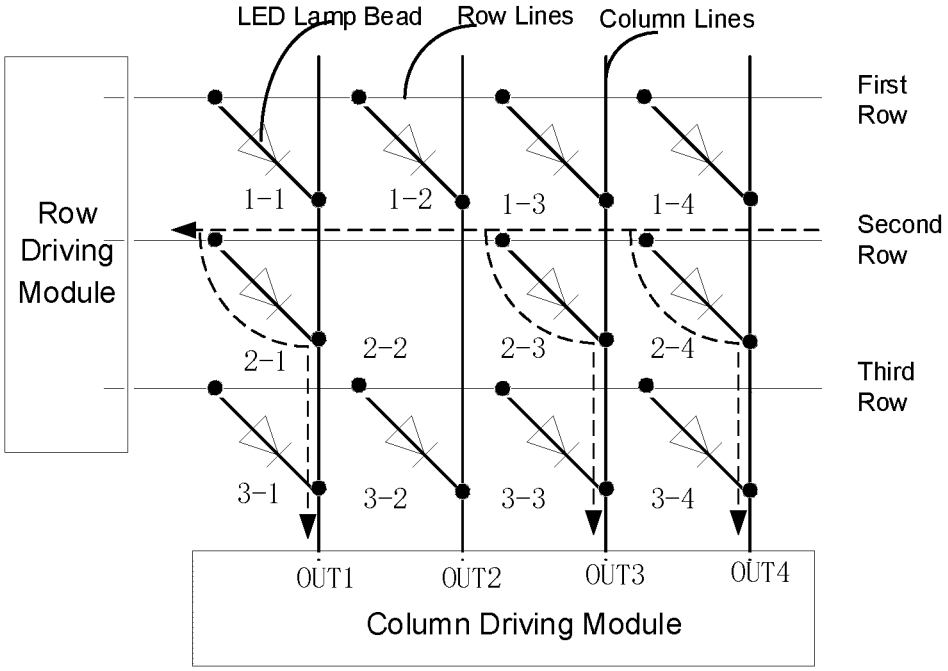
FIG. 1 is a schematic view showing a direction of current flow during detection of an open circuit in an LED display device in the prior art.

Reference Numerals: 10—LED display device; 11—row driving module; 12—column driving module; 13—LED display array; 130—LED lamp bead; 131—row line; 132—column line; 14—controller.

DETAILED DESCRIPTION OF EMBODIMENTS

In order to further clarify the objects, technical solutions, and advantages of the embodiments of the present disclosure, the technical solutions of the embodiments of the present disclosure will be described below clearly and completely with reference to the drawings of the embodiments of the present disclosure. It is apparent that the embodiments to be described are some, but not all of the embodiments of the present disclosure. Generally, the components of the embodiments of the present disclosure, as described and illustrated in the figures herein, may be arranged and designed in a wide variety of different configurations.

Thus, the following detailed description of the embodiments of the present disclosure, as represented in the figures, is not intended to limit the scope of the present disclosure as claimed, but is merely representative of selected embodiments of the present disclosure. All the other embodiments obtained by those of ordinary skill in the art in light of the embodiments of the present disclosure without inventive efforts shall fall within the scope of the present disclosure as claimed.

It should be noted that like reference numerals and letters refer to like items in the following figures, and thus once an item is defined in one figure, it may not be further defined or explained in the following figures.

At present, whether an LED lamp bead controlled at the intersection between a row line and a column line is in an open circuit state is judged and detected according to the magnitude of the electric potential of the column line, wherein in a case where the column driving module is grounded, column lines corresponding to LED lamp beads in a normal state usually each have an electric potential V1 of 1.3 V to 1.4 V (this value is only given as an example, similarly hereinafter), and the column line corresponding to an LED lamp bead in the open circuit state may have an electric potential V2 of 0.3 V to 0.4 V when there is no short-circuited lamp bead. If an open circuit electric potential V0 is set to be 0.6 V, it can be considered an LED lamp bead corresponding to a column line having an electric potential higher than the open circuit electric potential V0 is in the normal state, and an LED lamp bead corresponding to a column line having an electric potential lower than the open circuit electric potential V0 is in the open circuit state. However, once there is a short-circuited lamp bead in the display area of the LED display device during detection of the LED lamp beads, an LED lamp bead in an open circuit state that is not in the same row as the short-circuited lamp bead cannot be detected correctly.

Figure 2:
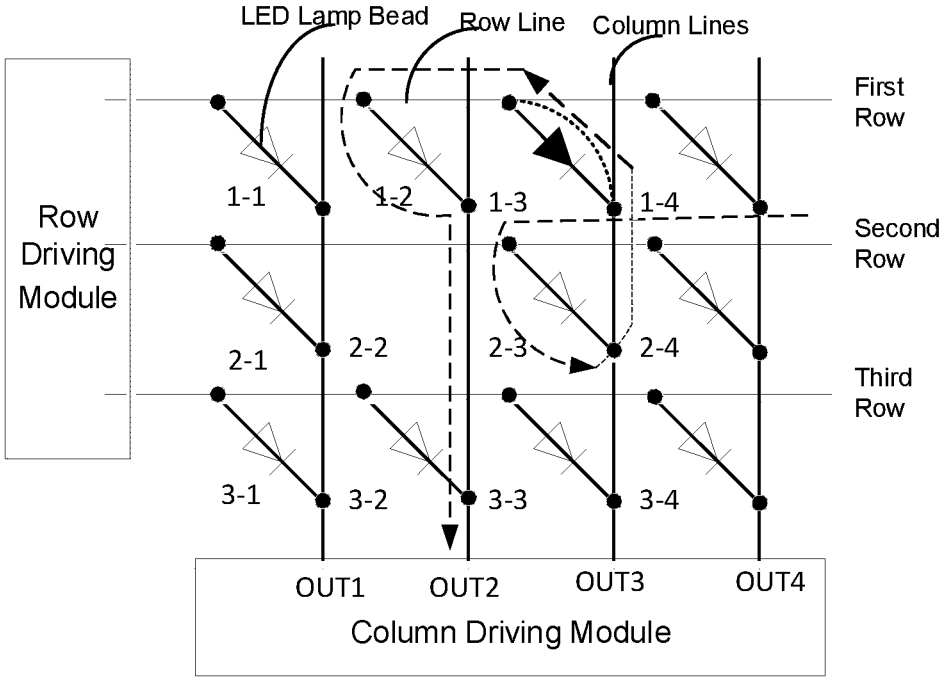
FIG. 2 is a schematic view showing a direction of current flow during detection of an open circuit in an LED display device having a short-circuited lamp bead in the prior art.

For example, referring to FIG. 2, in some embodiments, an open circuit is being detected while the LED display device is normally displaying. At this time, the row driving module controls row lines other than the row line to be detected to pulled down their electric potentials to Vdn, wherein Vdn>Vdd−Vf. It is assumed that the LED lamp bead 2-2 is open-circuited and the LED lamp bead 1-3 is short-circuited, and a pull-down method of pulling down to a preset electric potential Vdn and then releasing is used by the row driving module. Then, when the second row is being scanned for the detection of an open circuit, all the rows other than the second row are in an idle state, therefore the detection current flows in a direction as shown by the dashed line in FIG. 2, and the detection current may flow in from the row line in the second row and flow out from OUT2 through the LED lamp bead 2-3, the LED lamp bead 1-3 (corresponding to a conducting wire), and the LED lamp bead 1-2. Thus, the column line corresponding to OUT2 has an electric potential Vout2=Vdd−Vf (LED lamp bead 2-3)−Vf (LED lamp bead 1-2). Because Vout2>V0, that is to say, the column line corresponding to OUT2 is in a non-floating state, the open circuit state of the LED lamp bead 2-2 cannot be detected correctly, which results in a misjudgment.

For another example, referring again to FIG. 2, it is assumed that the LED lamp bead 2-2 is open-circuited and the LED lamp bead 1-3 is short-circuited, and a pull-down method of continuously pulling down the electric potential to Vdn is used by the row driving module. Then, when the second row is being scanned for the detection of an open circuit, all the rows other than the second row are in a state of being continuously pulled down, therefore the detection current flows in a direction as shown by the dashed line in FIG. 2, and may flow in from the row line in the second row and flow out from OUT2 through the LED lamp bead 2-3, the LED lamp bead 1-3 (corresponding to a conducting wire), and the LED lamp bead 1-2. Thus, the column line corresponding to OUT2 may have an electric potential Vout2=Vdn−Vf (LED lamp bead 1-2). In accordance with the condition Vdn>Vdd−Vf, it can be obtained that Vout2>Vdd−Vf−Vf(LED lamp bead 1-2), that is, Vout2>V0. That is to say, the column line corresponding to OUT2 is in a non-floating state. Thus, the open circuit state of the LED lamp bead 2-2 cannot be detected correctly, which results in a misjudgment.

In view of this, embodiments of the present disclosure provide an open circuit detection method and an LED display device, wherein during open circuit detection, when a certain row is being scanned for detection of an open circuit, the electric potentials of row lines other than the current row line may be pulled down in such a manner that the pulled-down electric potential is lower than an ON-voltage of the LED lamp beads, thereby avoiding the problem of failure in open circuit detection. The technical solutions provided in the embodiments of the present disclosure will be explained in detail below.

An embodiment of the present disclosure provides an open circuit detection method applicable in detecting an open circuit of an LED lamp bead of an LED display device, wherein the LED display device includes a plurality of row lines, a plurality of column lines, and a plurality of LED lamp beads, and each of the LED lamp beads has a positive electrode connected with one of the row lines, and a negative electrode connected with one of the column lines.

Figure 3:
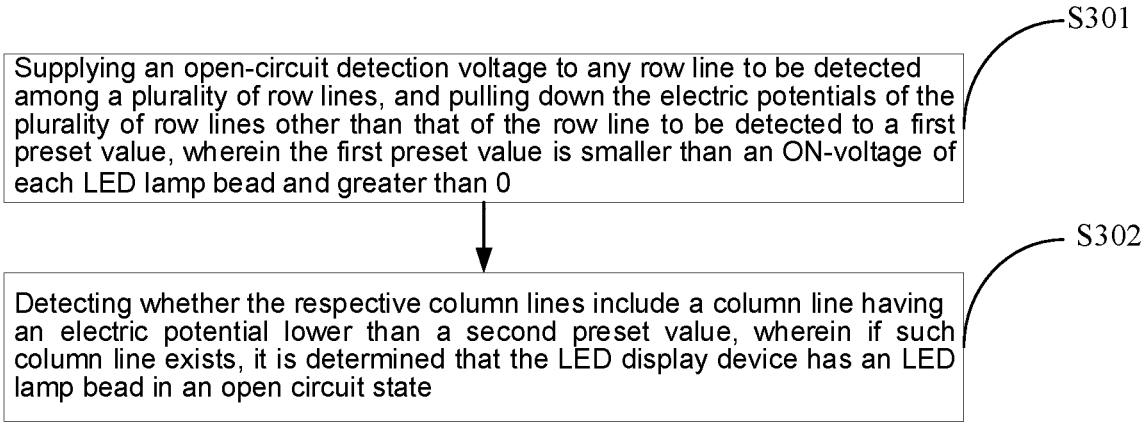
FIG. 3 is a schematic flowchart of an open circuit detection method according to an embodiment of the present disclosure.

FIG. 3 shows a flowchart of an open circuit detection method. It should be noted that the open circuit detection method provided in the present disclosure is not limited by the specific sequence shown in FIG. 3 and described below, for example, the order of some steps in the open circuit detection method described in the present disclosure may be interchanged with each other according to actual requirements, or some of the steps may be omitted or deleted. As shown in FIG. 3, the open circuit detection method includes the following steps:

step S301 of supplying an open-circuit detection voltage to any row line to be detected among a plurality of row lines, and pulling down the electric potentials of the plurality of row lines other than that of the row line to be detected to a first preset value, wherein the first preset value is smaller than an ON-voltage of each LED lamp bead and greater than 0; and step S302 of detecting whether the respective column lines include a column line having an electric potential lower than a second preset value, wherein if such column line exists, it is determined that the LED display device has an LED lamp bead in an open circuit state.

Here, the second preset value is the magnitude of the open-circuit electric potential V0 described above. The second preset value may be set flexibly as required. For example, in this embodiment, the second preset value may range from 0.5 V to 1.2 V. When the electric potential of a column line is lower than the second preset value, the column line is considered to be in a floating state, and when there is a column line in a floating state, it can be determined that the LED display device has an LED lamp bead in an open circuit state. In actual implementation, an LED lamp bead located at the intersection between the row line to be detected and the column line having an electric potential lower than the second preset value may be determined as the lamp bead in the open circuit state.

In detail, in the open circuit detection method provided in the above steps S301 and S302, the presence or absence of an open circuit problem in the LED lamp beads corresponding to the row line in each row is scanned and detected sequentially in accordance with a preset time, or an open circuit detection may be performed only in the LED lamp beads of the LED display device that are corresponding to the row line in a certain row, which is not limited in this embodiment herein. In addition, when the electric potentials of the plurality of row lines other than the row line to be detected are to be pulled down to the first preset value, a continuous pull-down method may be used so that the electric potentials of the row lines other than the row line to be detected are continuously pulled down to the first preset value, or a method of pulling down to the preset electric potential and then releasing may be used so that the electric potentials of the row lines other than the row line to be detected are pulled down to the first preset value and then released (there is a sustained duration in which the electric potential is maintained after the electric potential is pulled down to a preset electric potential and before it is released, and an idle duration may be set to be shorter than the sustained duration so as to ensure that the electric potentials of the other row lines are always in a state of being pulled down to the first preset value during the open circuit detection), which is not limited in this embodiment herein. In addition, the magnitude of the above-mentioned open-circuit detection voltage may be set according to actual requirements, for example, the open-circuit detection voltage may be greater than or equal to the ON-voltage of the LED lamp beads.

Figure 4:
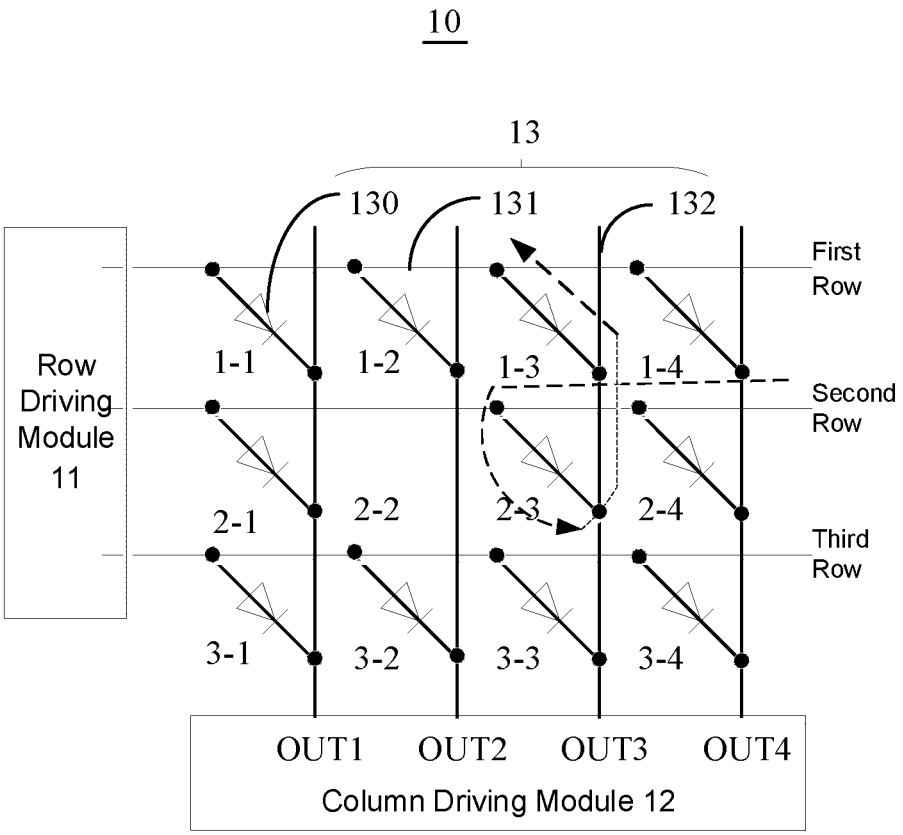
FIG. 4 is a schematic view showing a direction of current flow during detection of an open circuit in an LED display device having a short-circuited lamp bead according to an embodiment of the present disclosure.

In order to facilitate understanding, the principle of the open circuit detection according to the embodiment of the present disclosure will be described below with reference to a schematic view showing a direction of current flow during detection of an open circuit in an LED display device having a short-circuited lamp bead as shown in FIG. 4. Here, the LED display device 10 includes a row driving module 11, a column driving module 12, and an LED display array 13. Here, the LED display array 13 includes a plurality of row lines 131, a plurality of column lines 132, and a plurality of LED lamp beads 130, and each of the LED lamp beads 130 has a positive electrode connected with one of the row lines 131, and a negative electrode connected with one of the column lines 132. The row driving module 11 is connected with each of the row lines 131, and the column driving module 12 is connected with each of the column lines 132.

It is assumed that, in FIG. 4, the LED lamp bead 2-2 is open-circuited, the LED lamp bead 1-3 is short-circuited (corresponding to a conducting wire), the row line to be detected is a row line 131 in the second row, the ON-voltage of the LED lamp beads 130 is Vf, and the first preset value is Vdn. Then, when the second row is being scanned for detection of an open circuit, the row driving module 11 may supply an open-circuit detection voltage with a magnitude of Vdd to the row line 131 and pull down the electric potentials of the rows (e.g., the row line 131 in the first row, the row line 131 in the third row, and so on) other than the second row to the first preset value Vdn, where $0<Vdn<Vf$. Since the row line in the first row has the electric potential $Vdn<Vf$, the detection current flows in a direction as shown by the dashed line in FIG. 4 during the open circuit detection. That is to say, the LED lamp bead 1-2 cannot be turned on, the electric potential Vout2 of the column line corresponding to OUT2 is smaller than the open-circuit electric potential V0, and the column line 132 corresponding to OUT2 is in a floating state, whereby it is detected that the LED lamp bead 2-2 is in an open circuit state.

Figure 5:
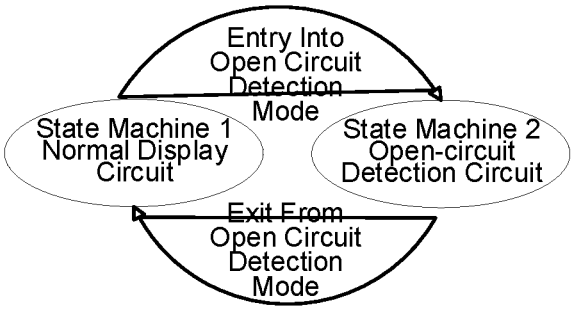
FIG. 5 is a schematic view showing switching between operating modes of an LED display device according to an embodiment of the present disclosure.

Optionally, in actual implementation, the operating modes of the LED display device 10 may include a normal display mode and an open circuit detection mode. Here, in the normal display mode, each row line 131 is driven by the row driving module 11 to have an electric potential pulled up to a high electric potential, and each column line 132 is driven by the column driving module 12 to have an electric potential pulled down to a low electric potential (e.g., 0 V to 1 V), so that a sufficient voltage difference is formed between the positive and negative electrodes of each LED lamp bead 130 connected across the respective column line 132 and row line 131 such that the LED lamp beads 130 are turned on. When it is necessary to carry out an open circuit detection, as shown in FIG. 5, the LED display device 10 may be controlled to switch from the normal display mode to the open circuit detection mode using command control. It should be noted that the normal display circuit and the open-circuit detection circuit shown in FIG. 5 have the same circuit structure.

Based on the above, in the open circuit detection method provided in the present disclosure, a state machine of a new open circuit detection mode as shown in FIG. 5 is added on the basis of the prior open-circuit detection circuit, and the problem of failure in open circuit detection caused by the presence of a short-circuited lamp bead in the LED display device 10 in the prior art is avoided by using the mutual cooperation between the row driving module 11 and the column driving module 12. Therefore, in the present disclosure, before execution of the step S301 and the step S302, the open circuit detection method described above may further include: switching from a current display mode to an open circuit detection mode in response to an open circuit detection command and based on the open circuit detection command.

In this embodiment, while an open-circuit detection voltage is supplied to the row line to be detected, the electric potentials of the row lines other than the row line to be detected are pulled down to a first preset value which is greater than zero and smaller than the ON-voltage of each LED lamp bead, and then the presence or absence of an open circuit problem in an LED lamp bead connected with the row line to be detected is judged according to the presence or absence of a column line having an electric potential lower than a second preset value in the respective column lines, thereby improving the validity and accuracy of the detection of an open circuit in the LED lamp beads of the LED display device and effectively avoiding the problem of failure in open circuit detection caused by the presence of a short-circuited lamp bead in the LED display device in the prior art.

An embodiment of the present disclosure also provides another open circuit detection method. In this open circuit detection method, compared with the method shown in FIG. 3 described above, before the open circuit detection is performed, whether the LED display device has an LED lamp bead in a short-circuited state is detected, wherein if such LED lamp bead exists, the steps S301 and S302 shown in FIG. 3 are executed, and if such LED lamp bead does exist, the subsequent process of open circuit detection may be performed in the prior art manner, thereby avoiding the problem of failure in open circuit detection caused by the presence of a short-circuited lamp bead in the prior art.

Figure 6:
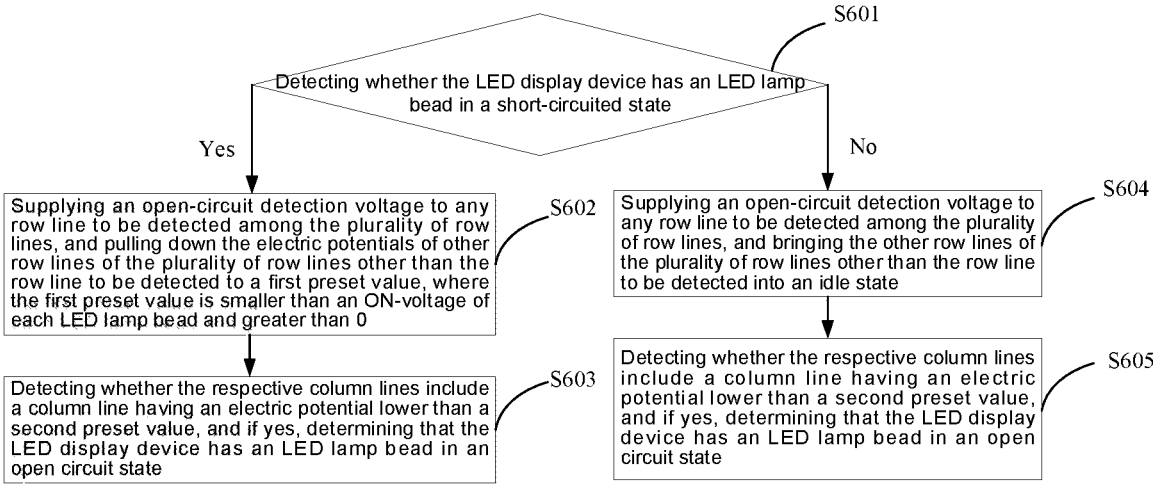
FIG. 6 is a flowchart of another open circuit detection method according to an embodiment of the present disclosure.

Optionally, referring to a flowchart of an open circuit detection method shown in FIG. 6, the open circuit detection method includes the following steps:

In step S601, it is detected whether the LED display device has an LED lamp bead in a short-circuited state;

wherein if such LED lamp bead exists, step S602 and step S603 are executed. and if such LED lamp bead does not exist, step S604 and step S605 are executed.

In the above step S601, referring to FIG. 4, when judging whether the LED display device 10 has an LED lamp bead 130 in a short-circuited state, since a short-circuited LED lamp bead 130 is equivalent to an LED lamp bead 130 having both ends connected with one conducting wire, it may be judged, when the row line 131 in a certain row is being detected and scanned, whether or not the plurality of column lines 132 include a column line having a too high electric potential or having an electric potential equal to the short-circuit detection voltage applied to the row line to be detected may be judged. When there is a column line 132 having a too high electric potential or having an electric potential equal to the short-circuit detection voltage, it is determined that the LED display device 10 has an LED lamp bead 130 in a short-circuited state, and the row line 131 corresponding to the row being currently detected is a short-circuited row line, and an LED lamp bead 130 located at the intersection between the short-circuited row line and the column line 132 having an abnormal electric potential is a short-circuited lamp bead.

On this basis, the step S601 includes: supplying a short-circuit detection voltage to any row line to be detected among the plurality of row lines; detecting whether the respective column lines include a column line having an electric potential higher than a third preset value or equal to the short-circuit detection voltage, and, if such column line exists, determining that the LED display device has an LED lamp bead in a short-circuited state. Here, the third preset value may be set according to the actual situation, and is not limited herein.

In step S602, an open-circuit detection voltage is supplied to any row line to be detected among the plurality of row lines, and the electric potentials of the plurality of row lines other than the row line to be detected are pulled down to a first preset value, wherein the first preset value is smaller than an ON-voltage of each LED lamp bead and greater than 0.

In step S603, it is detected whether the respective column lines include a column line having an electric potential lower than a second preset value, wherein if such column line exists, it is determined that the LED display device has an LED lamp bead in an open circuit state.

In step S604, an open-circuit detection voltage is supplied to any row line to be detected among the plurality of row lines, and the plurality of row lines other than the row line to be detected are brought into an idle state.

In step S605, it is detected whether the respective column lines include a column line having an electric potential lower than a second preset value, wherein if such column line exists, it is determined that the LED display device has an LED lamp bead in an open circuit state.

In this embodiment, before the open circuit detection is performed, first it is detected whether the LED display device has an LED lamp bead in a short-circuited state, wherein if such LED lamp bead exists, an open-circuit detection voltage is supplied to any row line to be detected among the plurality of row lines, and the electric potentials of the plurality of row lines other than the row line to be detected are pulled down to a first preset value, thereby avoiding the problem of failure in open circuit detection caused by the presence of a short-circuited lamp bead in the prior art.

Figure 7:
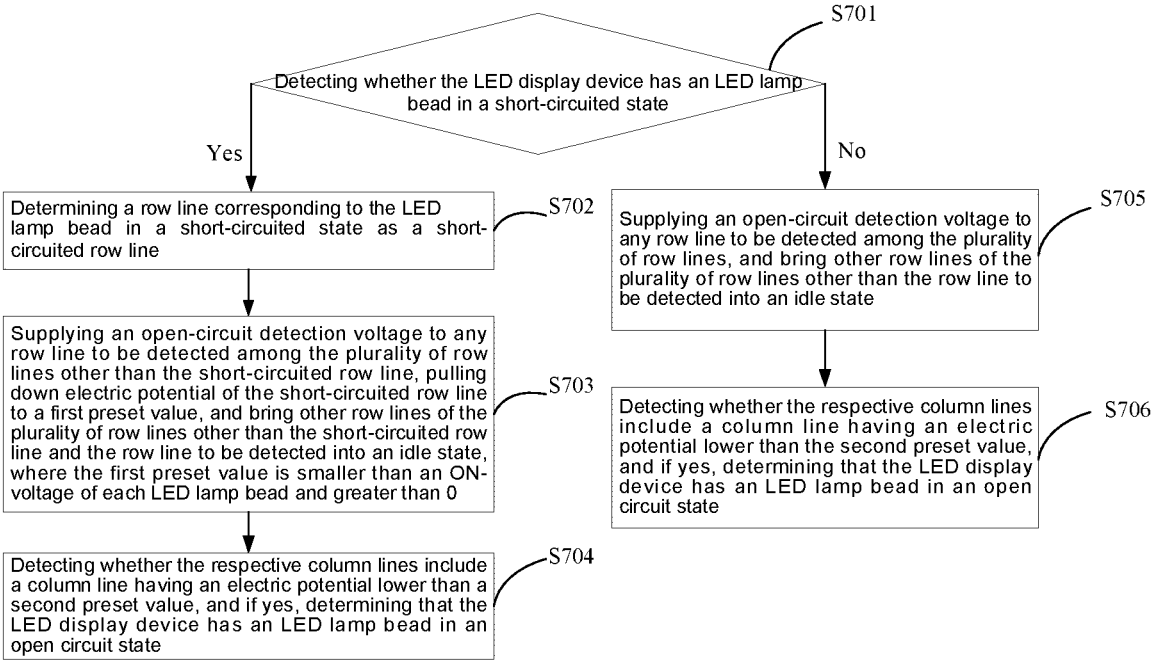
FIG. 7 is a flowchart of another open circuit detection method according to an embodiment of the present disclosure.

An embodiment of the present disclosure also provides another open circuit detection method, as shown in FIG. 7, which is applicable to detecting an open circuit of an LED lamp bead in an LED display device, wherein the LED display device includes a plurality of row lines, a plurality of column lines, and a plurality of LED lamp beads, and each of the LED lamp beads has a positive electrode connected with one of the row lines, and a negative electrode connected with one of the column lines. However, the open circuit detection method provided in the present disclosure is not limited by the specific sequence shown in FIG. 7 and described below, for example, the order of some steps in the open circuit detection method described in the present disclosure may be interchanged with each other according to actual requirements, or some of the steps may be omitted or deleted.

As shown in FIG. 7, an open circuit detection method according to this embodiment includes the following steps:

In step S701, it is detected whether the LED display device has an LED lamp bead in a short-circuited state, wherein if such LED lamp bead exists, steps S702 to S704 are executed, and if such LED lamp bead does not exist, steps S705 to S706 are executed.

In step S702, a row line corresponding to the LED lamp bead in a short-circuited state is determined as a short-circuited row line.

In step S703, an open-circuit detection voltage is supplied to any row line to be detected among the plurality of row lines other than the short-circuited row line, the electric potential of the short-circuited row line is pulled down to a first preset value, and the plurality of row lines other than the short-circuited row line and the row line to be detected are brought into an idle state, wherein the first preset value is smaller than an ON-voltage of each LED lamp bead and is greater than 0.

It should be noted that the electric potential of the short-circuited row line may be pulled down to a first preset value by using a continuous pull-down method or by using a method of pulling down to the first preset value and then releasing, which is not described in detail in this embodiment herein.

In step S704, it is detected whether the respective column lines include a column line having an electric potential lower than a second preset value, and if such column line exists, it is determined that the LED display device has an LED lamp bead in an open circuit state.

In step S705, an open-circuit detection voltage is supplied to any row line to be detected among the plurality of row lines, and the plurality of row lines other than the row line to be detected are brought into an idle state.

In step S706, it is detected whether the respective column lines include a column line having an electric potential lower than the second preset value, and if yes, it is determined that the LED display device has an LED lamp bead in an open circuit state.

When it is determined that the LED display device has an LED lamp bead in an open circuit state, an LED lamp bead located at the intersection between the row line to be detected and the column line having an electric potential lower than the second preset value may be determined as the lamp bead in an open circuit state.

It should be noted that the open circuit detection method provided in the above steps S701 to S706 has the same technical features as the open circuit detection method provided in the foregoing embodiment given with FIG. 3 or FIG. 6, therefore the detailed description of the above steps S701 to S706 may be understood with reference to the detailed description in the foregoing embodiment, and details thereof will be omitted in this embodiment herein.

Compared with the open circuit detection method provided in the embodiment shown in FIG. 6, in the above-mentioned open circuit detection method provided in this embodiment, after it is detected that the LED display device has an LED lamp bead in a short-circuited state, the electric potential of the short-circuited row line may be pulled down to the first preset value during open circuit detection, thereby avoiding the problem of failure in open circuit detection caused by the presence of the short-circuited lamp bead in the prior art.

Figure 8:
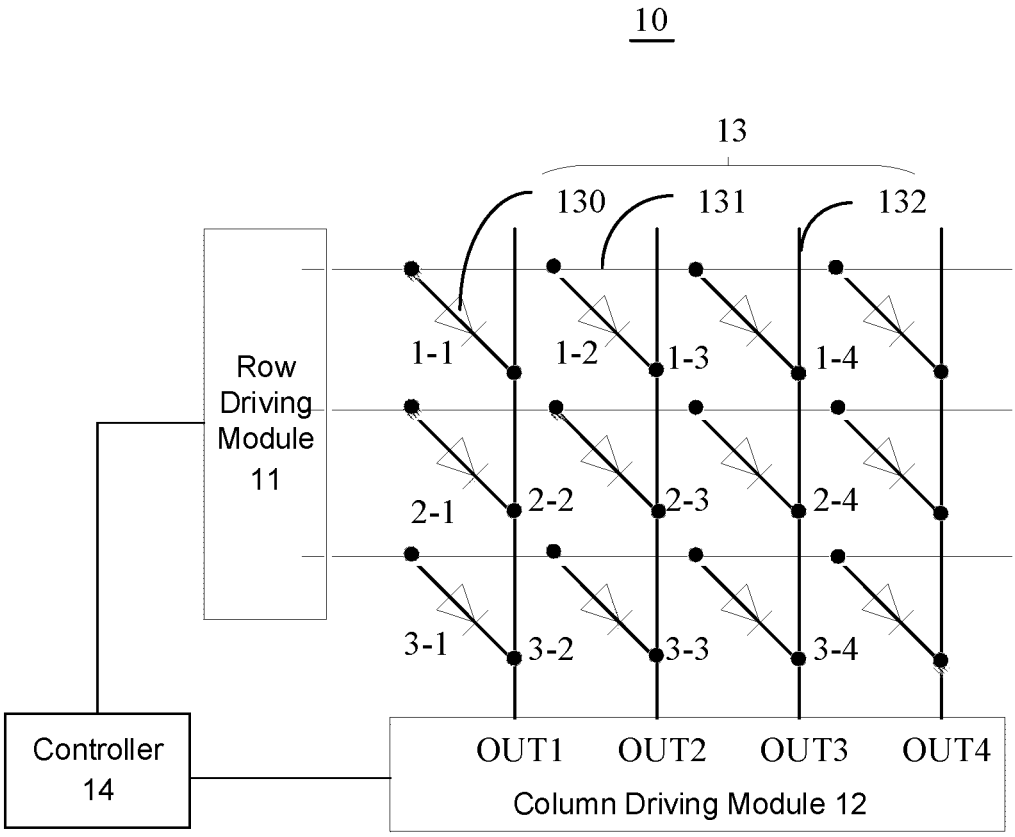
FIG. 8 is a structural block diagram of an LED display device according to an embodiment of the present disclosure.

In addition, an embodiment of the present disclosure provides an LED display device. Referring to a structural block diagram of an LED display device shown in FIG. 8, the LED display device 10 includes a row driving module 11, a column driving module 12, an LED display array 13, and a controller 14.

Here, the LED display array 13 includes a plurality of row lines 131, a plurality of column lines 132, and a plurality of LED lamp beads 130, and each of the LED lamp beads 130 has a positive electrode connected with one of the row lines 131, and a negative electrode connected with one of the column lines 132.

The above-mentioned row driving module 11 is connected with each of the row lines 131, and the row driving module 11 is configured to supply an open-circuit detection voltage to a row line to be detected among the plurality of row lines 131 and to pull down the electric potentials of the row lines 131 other than the row line to be detected among the plurality of row lines 131 to a first preset value, wherein the first preset value is smaller than an ON-voltage of each LED lamp bead 130 and greater than 0.

The above-mentioned column driving module 12 is connected with each of the column lines 132, and the column driving module 12 is configured to supply a driving voltage to each of the column lines 132 so that a voltage difference is formed between both ends of each LED lamp bead 130 connected with the row line to be detected to allow the LED lamp bead 130 to be turned on. Optionally, the column driving module 12 may be, but is not limited to, a constant current source driving module.

The above-mentioned controller 14 is connected with the row driving module 11 and the column driving module 12, respectively, and the controller 14 is configured to control the row driving module 11 to supply an open-circuit detection voltage to any row line to be detected among the plurality of row lines 131 and to pull down the electric potentials of row lines 131 other than the row line to be detected among the plurality of row lines 131 to a first preset value, wherein the first preset value is smaller than the ON-voltage of each LED lamp bead 130 and greater than 0. The controller 14 is further configured to detect whether the respective column lines 132 include a column line 132 having an electric potential lower than a second preset value, wherein if such column line exists, it is determined that the LED display device has an LED lamp bead 130 in an open circuit state.

An embodiment of the present disclosure also provides an LED display device. Referring still to the structural block diagram of an LED display device shown in FIG. 8, the LED display device 10 includes a row driving module 11, a column driving module 12, an LED display array 13, and a controller 14.

Here, the LED display array 13 includes a plurality of row lines 131, a plurality of column lines 132, and a plurality of LED lamp beads 130, wherein each of the LED lamp beads 130 has a positive electrode connected with one of the row lines 131, and a negative electrode connected with one of the column lines 132.

The above-mentioned row driving module 11 is connected with each of the row lines 131, and the row driving module 11 is configured to supply, when the plurality of row lines 131 include a short-circuited row line, an open-circuit detection voltage to any row line to be detected among the plurality of row lines 131 other than the short-circuited row line, pull down the electric potential of the short-circuited row line to a first preset value, and bring the row lines 131 other than the short-circuited row line and the row line to be detected among the plurality of row lines 131 into an idle state, wherein the short-circuited row line is a row line corresponding to an LED lamp bead in a short-circuited state, and the first preset value is smaller than an ON-voltage of each LED lamp bead 130 and greater than 0.

The above-mentioned column driving module 12 is connected with each of the column lines 132, and the column driving module 12 is configured to supply a driving voltage to each of the column lines 132 so that a voltage difference is formed between both ends of each LED lamp bead 130 connected with the row line to be detected to allow the LED lamp bead 130 to be turned on. Optionally, the column driving module 12 may be, but is not limited to, a constant current source driving module.

The above-mentioned controller 14 is respectively connected with the row driving module 11 and the column driving module 12, and the controller 14 is configured to: detect whether the LED display device 10 has an LED lamp bead 130 in a short-circuited state, wherein if such LED lamp bead exists, a row line 131 corresponding to the LED lamp bead in a short-circuited state is determined as a short-circuited row line; and to control the row driving module 11 to supply an open-circuit detection voltage to any row line to be detected among the plurality of row lines 131 other than the short-circuited row line, pull down the electric potential of the short-circuited row line to a first preset value, and bring the row lines 131 other than the short-circuited row line and the row line to be detected among the plurality of row lines 131 into an idle state, wherein the first preset value is smaller than the ON-voltage of each LED lamp bead and greater than 0. The controller 14 is further configured to detect whether the respective column lines include a column line 132 having an electric potential lower than a second preset value, wherein if such column line exists, it is determined that the LED display device 10 has an LED lamp bead 130 in an open circuit state.

In summary, in the open circuit detection method and the LED display device 10 according to the embodiments of the present disclosure, while an open-circuit detection voltage is supplied to the row line to be detected, the electric potential of each row line 131 other than the row line to be detected or the electric potential of the short-circuited row line is pulled down to a first preset value which is greater than zero and smaller than the ON-voltage of each LED lamp bead 130, and then the presence or absence of an open circuit problem in an LED lamp bead 130 connected with the row line to be detected is judged according to the presence or absence of a column line 132 having an electric potential lower than a second preset value in the respective column lines 132, thereby improving the validity and accuracy of detection of an open circuit in the LED display device 10.

Moreover, the open circuit detection method provided in the present disclosure can effectively avoid the problem of failure in open circuit detection caused by the presence of a short-circuited lamp bead in the LED display device 10 in the prior art without changing the circuit structure of the prior LED display device 10.

In the description of the present disclosure, the terms "disposed", "coupled", and "connected" should be understood in a broad sense. For example, a connection may be fixed connection or detachable connection or integral connection, may be mechanical connection or electric connection, or may be direct coupling or indirect coupling via an intermediate medium or internal communication between two elements. The specific meanings of the above-mentioned terms in the present disclosure can be understood by those of ordinary skill in the art according to specific situations.

The above description is merely illustrative of some embodiments of the present disclosure and is not intended to limit the present disclosure. It will be understood by those skilled in the art that various modifications and variations can be made to the present disclosure. Any modifications, equivalent alternatives, improvements and so on made within the spirit and principle of the present disclosure are to be included in the scope of protection of the present disclosure.

INDUSTRIAL APPLICABILITY

With the application of the technical solutions of the present disclosure, the validity and accuracy of detection of an open circuit in an LED lamp bead of an LED display device are improved, and the problem of failure in open circuit detection caused by the presence of a short-circuited lamp bead in the LED display device in the prior art can be effectively avoided.

What is claimed is:

1. An open circuit detection method, applicable to detecting an open circuit of an LED lamp bead in an LED display device, the LED display device comprising a plurality of row lines, a plurality of column lines, and a plurality of LED lamp beads, wherein each of the LED lamp beads has a positive electrode connected with one of the row lines, and a negative electrode connected with one of the column lines, and the open circuit detection method comprises:

supplying an open-circuit detection voltage to any row line to be detected among the plurality of row lines, and pulling down to a first preset value the electric potentials of row lines other than the row line to be detected among the plurality of row lines, wherein the first preset value is smaller than an ON-voltage of each of the LED lamp beads and greater than 0; and detecting, by a controller, whether the respective column lines comprise a column line having an electric potential lower than a second preset value, wherein if the column line having an electric potential lower than the second preset value exists, it is determined that the LED display device has an LED lamp bead in an open circuit state.

2. The open circuit detection method according to claim 1, wherein prior to the step of supplying an open-circuit detection voltage to any row line to be detected among the plurality of row lines, and pulling down to a first preset value the electric potentials of row lines other than the row line to be detected among the plurality of row lines, the open circuit detection method further comprises:

detecting whether the LED display device has an LED lamp bead in a short-circuited state, wherein if the LED display device has the LED lamp bead in the short-circuited state, the step of supplying an open-circuit detection voltage to any row line to be detected among the plurality of row lines is executed, and the electric potentials of the row lines other than the row line to be detected among the plurality of row lines are pulled down to the first preset value.

3. The open circuit detection method according to claim 2, wherein the detecting whether the LED display device has an LED lamp bead in a short-circuited state comprises:

supplying a short-circuit detection voltage to any row line to be detected among the plurality of row lines; and detecting whether the respective column lines comprise a column line having an electric potential higher than a third preset value or an electric potential equal to the short-circuit detection voltage, wherein if the column line having an electric potential higher than the third preset value or an electric potential equal to the short-circuit detection voltage exists, it is determined that the LED display device has the LED lamp bead in the short-circuited state.

4. The open circuit detection method according to claim 3, wherein the open circuit detection method further comprises:

supplying the open-circuit detection voltage to any row line to be detected among the plurality of row lines and bringing into an idle state the row lines other than the row line to be detected among the plurality of row lines if the LED display device does not have the LED lamp bead in the short-circuited state; and detecting whether the respective column lines comprise a column line having an electric potential lower than the second preset value, wherein if the column line having an electric potential lower than the second preset value exists, it is determined that the LED display device has the LED lamp bead in the open circuit state.

5. The open circuit detection method according to claim 3, wherein the pulling down to a first preset value the electric potentials of row lines other than the row line to be detected among the plurality of row lines comprises:

pulling down to a first preset value the electric potentials of the row lines other than the row line to be detected among the plurality of row lines to be pulled down and then releasing the electric potentials; or continuously pulling down to the first preset value the electric potentials of the row lines other than the row line to be detected among the plurality of row lines.

6. The open circuit detection method according to claim 2, wherein the open circuit detection method further comprises:

supplying the open-circuit detection voltage to any row line to be detected among the plurality of row lines and bringing into an idle state the row lines other than the row line to be detected among the plurality of row lines if the LED display device does not have the LED lamp bead in the short-circuited state; and detecting whether the respective column lines comprise a column line having an electric potential lower than the second preset value, wherein if the column line having an electric potential lower than the second preset value exists, it is determined that the LED display device has the LED lamp bead in the open circuit state.

7. The open circuit detection method according to claim 6, wherein the pulling down to a first preset value the electric potentials of row lines other than the row line to be detected among the plurality of row lines comprises:

pulling down to a first preset value the electric potentials of the row lines other than the row line to be detected among the plurality of row lines to be pulled down and then releasing the electric potentials; or continuously pulling down to the first preset value the electric potentials of the row lines other than the row line to be detected among the plurality of row lines.

8. The open circuit detection method according to claim 2, wherein the pulling down to a first preset value the electric potentials of row lines other than the row line to be detected among the plurality of row lines comprises:

pulling down to a first preset value the electric potentials of the row lines other than the row line to be detected among the plurality of row lines to be pulled down and then releasing the electric potentials; or continuously pulling down to the first preset value the electric potentials of the row lines other than the row line to be detected among the plurality of row lines.

9. The open circuit detection method according to claim 1, wherein the pulling down to a first preset value the electric potentials of row lines other than the row line to be detected among the plurality of row lines comprises:

pulling down to a first preset value the electric potentials of the row lines other than the row line to be detected among the plurality of row lines to be pulled down and then releasing the electric potentials; or continuously pulling down to the first preset value the electric potentials of the row lines other than the row line to be detected among the plurality of row lines.

10. The open circuit detection method according to claim 1, wherein the open circuit detection method further comprises:

determining an LED lamp bead located at an intersection between the row line to be detected and the column line having an electric potential lower than the second preset value, as the lamp bead in the open circuit state.

11. The open circuit detection method according to claim 1, wherein the open-circuit detection voltage is greater than the ON-voltage of the LED lamp beads.

12. The open circuit detection method according to claim 1, wherein prior to the step of supplying an open-circuit detection voltage to any row line to be detected among the plurality of row lines, and pulling down to a first preset value the electric potentials of row lines other than the row line to be detected among the plurality of row lines, the open circuit detection method further comprises:

switching from a current display mode to an open circuit detection mode in response to an open circuit detection command and based on the open circuit detection command.

13. An open circuit detection method, applicable to detecting an open circuit in an LED lamp bead of an LED display device, the LED display device comprising a plurality of row lines, a plurality of column lines, and a plurality of LED lamp beads, wherein each of the LED lamp beads has a positive electrode connected with one of the row lines, and a negative electrode connected with one of the column lines, and the open circuit detection method comprises:

detecting, by a controller, whether the LED display device has an LED lamp bead in a short-circuited state, wherein if the LED display device has the LED lamp bead in the short-circuited state, a row line corresponding to the LED lamp bead in the short-circuited state is determined as a short-circuited row line;

supplying an open-circuit detection voltage to any row line to be detected other than the short-circuited row line among the plurality of row lines, pulling down an electric potential of the short-circuited row line to a first preset value, and bringing into an idle state the row lines other than the short-circuited row line and the row line to be detected among the plurality of row lines, wherein the first preset value is smaller than an ON-voltage of each of the LED lamp beads and greater than 0; and detecting, by the controller, whether the respective column lines comprise a column line having an electric potential lower than a second preset value, wherein if the column line having an electric potential lower than the second preset value exists, it is determined that the LED display device has an LED lamp bead in an open circuit state.

14. The open circuit detection method according to claim 13, wherein the detecting whether the LED display device has an LED lamp bead in a short-circuited state comprises:

supplying a short-circuit detection voltage to any row line to be detected among the plurality of row lines;

detecting whether the respective column lines comprise a column line having an electric potential higher than a third preset value or an electric potential equal to the short-circuit detection voltage, wherein if the column line having an electric potential higher than the third preset value or an electric potential equal to the short-circuit detection voltage exists, it is determined that the LED display device has the LED lamp bead in the short-circuited state.

15. The open circuit detection method according to claim 13, wherein the pulling down an electric potential of the short-circuited row line to a first preset value comprises:

pulling the electric potential of the short-circuited row line to a first preset value and then releasing the electric potential; or continuously pulling down the electric potential of the short-circuited row line to the first preset value.

16. The open circuit detection method according to claim 13, wherein the open circuit detection method further comprises:

supplying an open-circuit detection voltage to any row line to be detected among the plurality of row lines and bringing into an idle state the row lines other than the row line to be detected among the plurality of row lines if the LED display device does not have the LED lamp bead in the short-circuited state; and detecting whether the respective column lines comprise a column line having an electric potential lower than the second preset value, wherein if the column line having an electric potential lower than the second preset value exists, it is determined that the LED display device has the LED lamp bead in the open circuit state.

17. The open circuit detection method according to claim 13, wherein the open-circuit detection voltage is greater than the ON-voltage of each of the LED lamp beads.

18. The open circuit detection method according to claim 13, wherein the method further comprises:

determining an LED lamp bead located at an intersection between the row line to be detected and the column line having an electric potential lower than the second preset value, as the lamp bead in the open circuit state.

19. An LED display device, comprising:

an LED display array comprising a plurality of row lines, a plurality of column lines, and a plurality of LED lamp beads, wherein each of the LED lamp beads has a positive electrode connected with one of the row lines, and a negative electrode connected with one of the column lines;

a row driving module connected with each of the row lines, wherein the row driving module is configured to supply an open-circuit detection voltage to any row line to be detected among the plurality of row lines and to pull down to a first preset value the electric potentials of row lines other than the row line to be detected among the plurality of row lines, wherein the first preset value is smaller than an ON-voltage of each of the LED lamp beads and greater than 0;

a column driving module connected with each of the column lines, wherein the column driving module is configured to supply a driving voltage to each of the column lines so that a voltage difference is formed between both ends of each LED lamp bead connected with the row line to be detected to allow the LED lamp bead to be turned on;

a controller respectively connected with the row driving module and the column driving module, wherein the controller is configured to control the row driving module to supply the open-circuit detection voltage to any row line to be detected among the plurality of row lines and to pull down to the first preset value the electric potentials of the row lines other than the row line to be detected among the plurality of row lines, wherein the first preset value is smaller than the ON-voltage of each of the LED lamp beads and greater than 0; and the controller is further configured to detect whether the respective column lines comprise a column line having an electric potential lower than a second preset value, wherein if the column line having an electric potential lower than the second preset value exists, it is determined that the LED display device has an LED lamp bead in an open circuit state.

20. The LED display device according to claim 19, wherein the column driving module is a constant current source driving module.

* * * * *